US005184730A

United States Patent [19]

Paul

[11] Patent Number: 5,184,730

[45] Date of Patent: Feb. 9, 1993

[54] METHOD AND APPARATUS USING FEED CONVEYING FLUID BLENDING THE FEED AND/OR SEPARATING DEBRIS FROM THE FEED

[75] Inventor: Kermit D. Paul, Bethlehem, Pa.

[73] Assignee: Fuller Company, Bethlehem, Pa.

[21] Appl. No.: 669,353

[22] Filed: Mar. 14, 1991

Related U.S. Application Data

[62] Division of Ser. No. 402,552, Sep. 5, 1989, Pat. No. 5,018,869.

[51] Int. Cl.[5] ..... B07B 7/00

[52] U.S. Cl. ..... 209/142; 209/139.1; 209/143; 209/150; 209/154; 406/28; 406/163; 406/171

[58] Field of Search ..... 209/142, 138, 139.1, 209/154, 146, 140, 149, 150, 143; 406/28, 30, 126, 157, 163, 171; 366/101, 107, 341

[56] References Cited

U.S. PATENT DOCUMENTS

| | | | |
|---|---|---|---|
| 1,793,098 | 2/1931 | Kramer | 406/171 X |
| 2,850,162 | 9/1958 | Widmer | 209/143 X |
| 3,635,377 | 1/1972 | Potvin | 406/171 X |
| 3,829,165 | 8/1974 | Boon | 406/171 |
| 4,540,421 | 9/1985 | Wilson | 406/171 X |
| 4,634,522 | 1/1987 | Edholm et al. | 209/154 |
| 4,968,188 | 11/1990 | Lucassen | 406/171 |
| 5,021,149 | 6/1991 | Geisseler | 209/143 X |

FOREIGN PATENT DOCUMENTS

| | | | |
|---|---|---|---|
| 1463664 | 3/1989 | U.S.S.R. | 406/30 |

*Primary Examiner*—Donald T. Hajec
*Attorney, Agent, or Firm*—Daniel DeJoseph

[57] ABSTRACT

A method and apparatus for blending a material feed and/or separating debris from a material feed is disclosed in which a feed separator is used with a blender and/or debris separator. The feed separator separates a feed from the conveying air flow which conveys the feed and the conveying air flow, devoid of feed, is then used to blend the conveyed feed and/or separate debris therefrom.

19 Claims, 6 Drawing Sheets

METHOD AND APPARATUS USING FEED CONVEYING FLUID BLENDING THE FEED AND/OR SEPARATING DEBRIS FROM THE FEED

This is a divisional of co-pending application Ser. No. 07/402,552 filed on Sep. 5, 1989 now U.S. Pat. No. 5,018,869, issued May 28, 1991.

BACKGROUND OF THE INVENTION

1. Field of the Invention

The present invention relates to the field of materials handling and more particularly to the fields of blending a material and/or separating debris from a material. During blending, materials from different production batches are blended together to achieve a homogeneous material blend having desired properties. During debris separation, undesired debris is separated from conveyed materials prior to a desired processing operation conducted on those materials.

The invention has particular utility in producing blends of plastic pellets and/or debris-free plastic pellets used in the plastics extrusion industry.

2. Discussion of the Prior Art

In the field of industrial materials processing, it is often desired to achieve a material which is blended from different sources to achieve a homogeneous blended material having desired characteristics. In the plastic pellet processing industry, for example, a blender is typically used in the final stages of preparing the plastic pellets for extrusion. Typically, the pellets are produced in batches and stored, with each batch having a particular chemical and/or physical property characteristic. Pellets of different batches, having these different characteristics, are blended together to achieve a homogeneous blended pellet batch which has desired end-user specified characteristics. For example, an end-user will typically specify the chemical and physical characteristics of the pellets which are desired for a particular extrusion operation, e.g., a desired polyethylene of a desired melt index, and the pellet supplier typically blends together polyethylene pellets of the various batches to obtain the user specification. As an example, one polyethylene pellet batch may have a melt index of $+1°$ over specification and another may have a melt index of $-1°$ below specification. By suitably blending the two polyethylene pellet batches together, the desired melt index is achieved.

During the process of manufacturing and conveying the plastic pellets, which are typically cylindrical in shape and of ⅛ to 3/16 inches in diameter and ⅛-3/16 inches long, plastic debris is created in the form of fines, streamers, "angle-hair" and "snake skins". This debris causes problems to an end-user, such as plugging of equipment, etc. and it is therefore desirable to remove this debris to the greatest extent possible from the pelletized material before it is sent to the end-user.

To better illustrate certain aspects of the invention, reference will first be made to FIGS. 1 and 2 which respectively illustrate two prior art material blenders. In a conventional bottom feed blender 11, illustrated in FIG. 1, a feed source 35 supplies plastic pellets to a conveying fluid stream generated by a blower 37. Typically, the blower 37 uses air as the conveying fluid and the conveying air stream conveys a stream of feed material from feed source 35 through conduit 33 and up a lift pipe 19 of the blender 11. The upwardly directed air stream and conveyed feed also pneumatically conveys material which is provided in the lower smaller diameter end 17 of blender 11 due to a physical spacing existing between the inlet end of lift pipe 19 and the conveying air stream inlet to section 17 of the blender. Thus, feed from feed source 35 as well as material within a lower portion of section 17 of blender 11 are conveyed upwardly through the lift pipe 19. At the top 23 of the blender 11, the conveyed feed exits an upper end 25 of the lift pipe 19 and falls by gravity onto a material inventory bed 27 provided within the interior walls 13 of blender 11. Blender 11 has a larger diameter upper section 13 to accommodate the inventory of feed material. The larger diameter upper section 13 and smaller diameter lower section 17 are interconnected by a funnel shaped intermediate section 15. The inventory 27 of feed material held within upper section 13 of blender 11 enters into vertical downcomers 29, which are spaced circumferentially around the interior periphery of the side wall of blender 11, through downcomer ports 21 which are spaced longitudinally along each of the downcomers 29. Feed material residing in the material feed inventory 27 enters the ports 21 and passes through the downcomers 29 to the bottom section 17 of the blender 11. Feed material in inventory bed 27 also moves downwardly to bottom section 17. The material in a lower end of bottom section 17 is pulled upwardly by the incoming upwardly directed conveying air flow.

After the blender 11 is loaded with sufficient incoming feed, the feed source 35 is cut off and the conveying air from blower 37 is used to continually recycle material within bed 27 of the blender 11. The blender then operates for a sufficient period of time to achieve a homogeneous blend of the material within the blender after which the blower 37 is shut off and the blended material is drained at drain valve 31 through the bottom of the blender 11. Thus, by the continual remixing and recirculation of material, such as plastic pellets, in the blender, a uniform blending is achieved.

One problem which occurs with the blender 11 of FIG. 1, is that too much pellet feed in the incoming air flow from blower 37, that is, a too large pellet concentration, will overload the air flow so that not enough pellets are pulled upwardly through the lift pipe 19 from the bottom section 17 of the blender. Thus, there is little or no pellet recycling and blending during the filling cycle of blender 11. Even if the pellet concentration from feed source 37 is adjusted properly, the recirculation ability of the blender is reduced during filling because the incoming air flow has the burden of conveying feed pellets from source 35 as well as recycling the pellets within the blender.

To overcome the problem with the blending apparatus illustrated in FIG. 1, one solution has been to provide separate blowers for conveying material into the blender and for recirculation of material within the blender. FIG. 2 illustrates such an arrangement in which blower 37 is used to convey through conduit 33 a feed from feed source 35. The feed is supplied to the top of the blender 11, which otherwise has the construction illustrated in FIG. 1. A separate recycling air flow is established by blower 43 which provides air in conduit 41 to the bottom section 17 of the blender as in the FIG. 1 arrangement.

Since blower 43 does not convey any feed, it only has the task of recirculating material within the blender 11 and thus is able to do a more efficient blending operation unhampered by the concentration of the feed source 35. Unfortunately, the approach illustrated in FIG. 2 has the disadvantage of requiring two separate blowers and associated conduits which increases the overall cost and complexity of the blending system.

SUMMARY OF THE INVENTION

In view of the problems attendant prior art blenders, the present invention has been devised. One object of the invention is the provision of a blender which uses a single blower and air flow to convey a pellet feed to the blender, in which the pellet feed is separated from the conveying air so that the conveying air alone is then used to recycle and recirculate the pellet material within the blender.

Another object of the invention is the provision of a blender as described in the preceding paragraph which further incorporates an integral feed separator for separating the conveyed material feed from the conveying air.

Another object of the invention is the provision of a blender as described in the preceding paragraph and further incorporating a control system for protecting and restarting the blender under upset conditions.

Another object of the invention is the provision of a blender as described above which further incorporates an integral feed separator for separating a conveyed material feed from conveying air and which further incorporates therein a debris separator.

Another object of the invention is the provision of a debris separator which uses a single blower and air flow to convey a material feed to the separator, and which further includes a feed separator for separating a conveyed material feed from the conveying air so that the conveying air alone is used to recycle and recirculate material within the debris separator.

Another object of the invention is the provision of a unique control system for providing an automatic control of a debris separation operation in accordance with the characteristics of the debris which are being separated from a material feed.

Another object of the invention is the provision of a blending system in which at least two blenders are connected to a single blower conveying a material feed, and in which the material feed is separated at each blender from the conveying air so that the conveying air alone is used to recycle and recirculate the material within a blender, and in which the blenders are interconnected to the feed conveying air flow and conveying air only flow so that each blender is operating in a different one of a filling and blending stage, a blending stage, a waiting stage and a draining stage from the other blender to achieve a continuous operation of the blenders with a single conveying air flow.

The above and other objects, advantages and features of the invention will be more readily understood from the following detailed description of the invention which is provided in connection with the accompanying drawings.

DETAILED DESCRIPTION OF THE INVENTION

Figure 1:
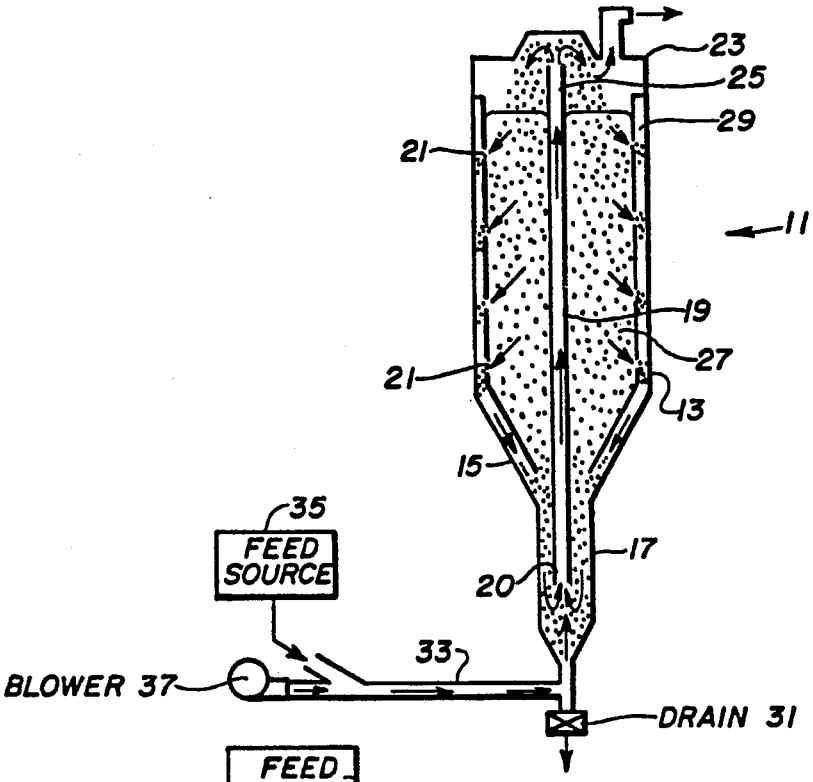
Fig. 1 PRIOR ART
FIG. 1 illustrates one embodiment of a conventional blender upon which the present invention improves.
Figure 2:
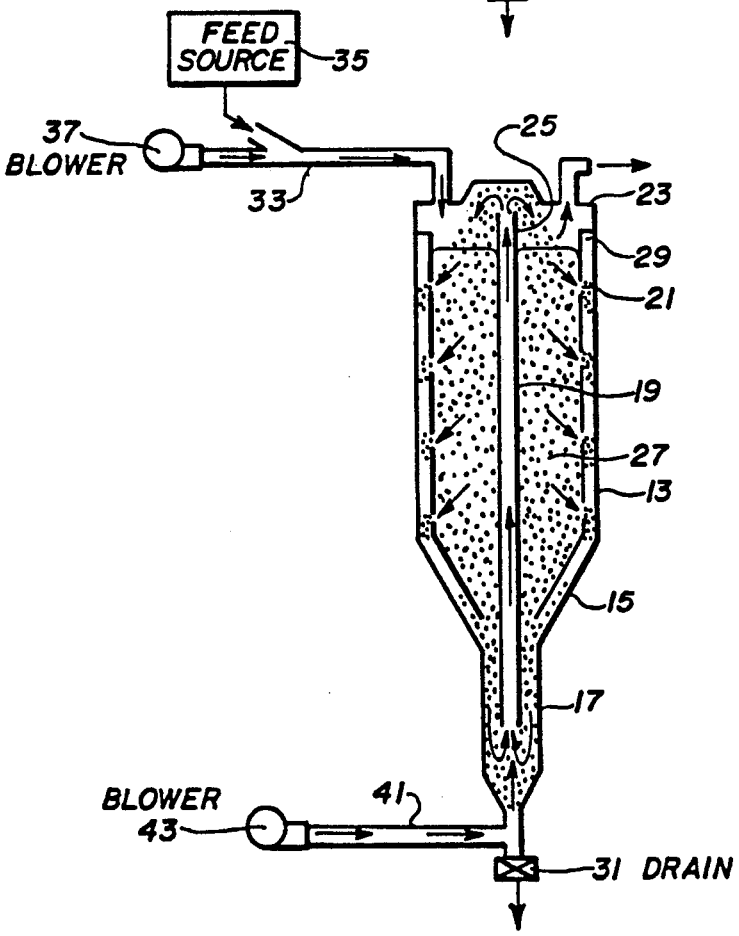
Fig. 2 PRIOR ART
FIG. 2 illustrates a second embodiment of a conventional blender upon which the present invention improves.
Figure 3:
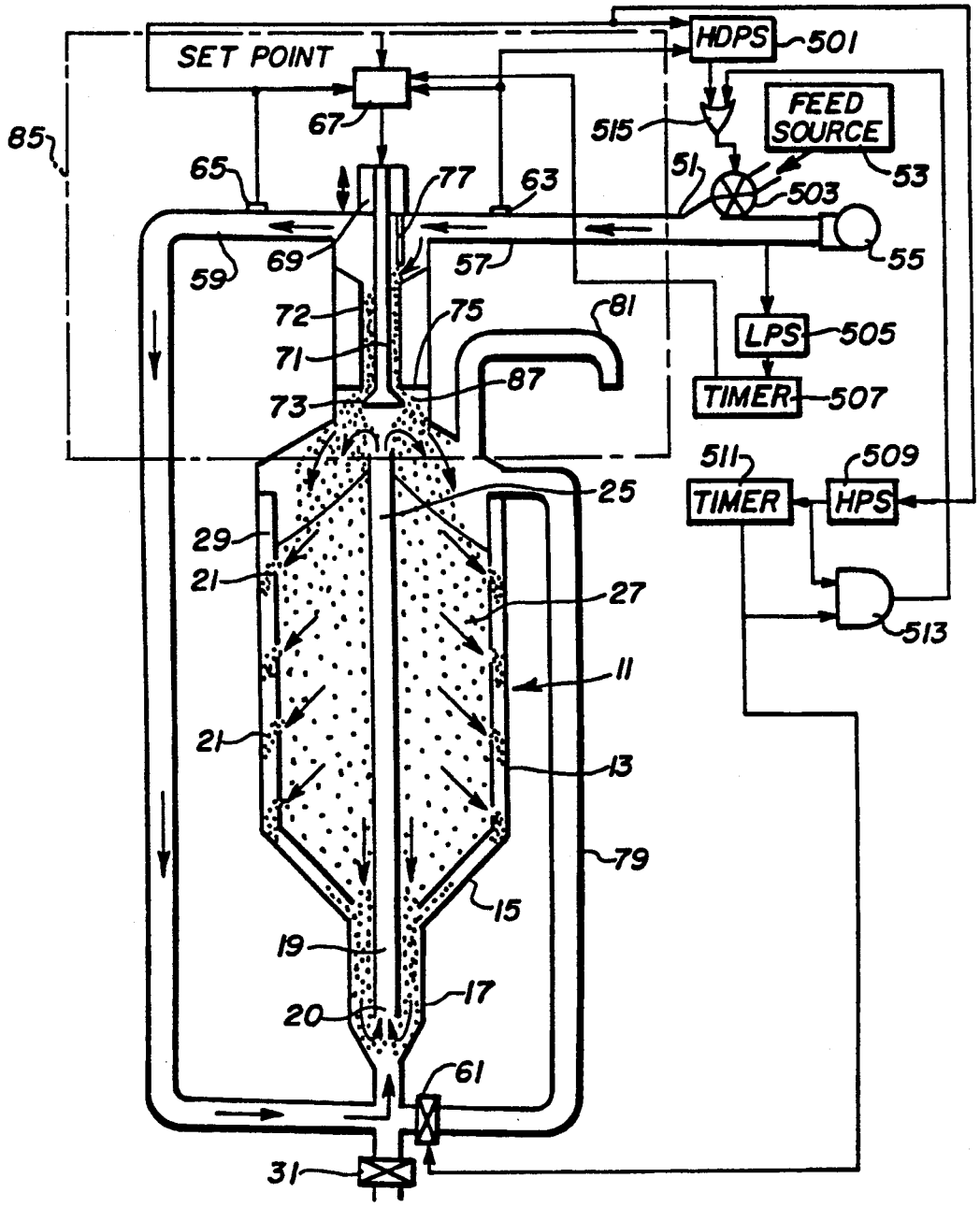
FIG. 3 illustrates a blender in a first embodiment of the invention which uses a single air flow for both conveying feed material to the blender and for recycling and recirculating of feed material within the blender using feed-free air.

FIG. 3 illustrates a first embodiment of a blender of the invention. In FIG. 3 those elements which are the same as corresponding elements in FIGS. 1 and 2 bear the same reference numbers. FIG. 3 illustrates a blender 11 having a large diameter cylindrical sidewall 13 which defines the main body of the blender, a funnel-shaped sidewall 15 which extends downwardly and inwardly from the cylindrical sidewall 13, and a smaller diameter cylindrical sidewall 17 which defines a lower section of blender 11. A lift pipe 19 is centrally disposed within the blender 11 and includes a lower end 20 which acts as a material and conveying air inlet for lift pipe 19.

As in the conventional blender, a plurality of downcomers 29 are provided which extend from an upper portion to a lower portion of the blender 11. Each of the downcomers is in the form of a conduit having ports 21 spaced therealong. The ports 21 acts as entry points for a feed material housed within the blender and within the section thereof defined by the cylindrical sidewall 13. The ports allow the material to enter into the downcomers and fall, by gravity, to the conical sidewall 15 which deposits the material from the downcomers 29 in the lower section 17 of the blender 11. A plurality of vertical downcomers 29 are provided spaced around the inner periphery of the side wall 13 of the blender. A material inventory 27 within the blender 11 also enters section 17 directly by means of a passage established along and outside the peripheral wall of lift pipe 19. Material and conveying air which passes upwardly through the lift pipe 19 exits the exit end 25 of the lift pipe. The conveying air then flows outwardly of the blender 11 through an outlet passage 81 while material which is conveyed upwardly through the lift pipe 19 is deposited by gravity in the material inventory 27 after it exits lift pipe 19.

A feed separator 85 is also provided at an upper portion 23 of the blender 11. Feed separator 85 operates to separate a conveyed feed from feed source 53 from a conveying air flow from blower 55. The conveyed feed and air flow pass through conduit 51 whereby they enter the feed separator 85. The purpose of feed separator 85 is to separate the feed from the conveying air so that the conveying air only flows through the separator outlet conduit 59. This air flow then enters the lower end 20 of lift pipe 19 and acts as the recycle or blending air flow for the blender 11. The air flow from conduit 59 which enters the lower end 20 of the lift pipe 19 conveys, upwardly through the lift pipe 19, material present in the lower section 17 of the blender. Thus, feed separator 85 operates to provide a feed-free recycle air flow through the lift pipe 19 to operate blender 11 and achieve a blending operation.

The feed separator 85 includes a feed separator inlet 57 through which the combined feed and conveying air enter. A baffle plate 77 is located substantially normal to the direction of conveying feed and air flow so that the feed hits the baffle plate and falls into a chamber defined by a cylindrical wall 72 within the feed separator 85. The conveying air passes down and around baffle plate 77 and exits from the feed separator through the separator conveying air outlet conduit 59.

A cylindrical wall 72 defines a chamber in which feed material passing through inlet 57 and striking baffle plate 77 is directed. Initially, during start-up, the chamber defined by cylindrical wall 72 is closed at its bottom by means of a conical deflector 73. Conical deflector 73 and the bottom of cylindrical wall 72 define a separator outlet 87 in the form of a gap which is adjustable upon vertical movement of conical deflector 73 which is attached to a vertically moveable shaft 71. Shaft 71 is in turn driven in a vertical direction by a driver 69 which receives a control signal from controller 67. As noted, initially, the gap defined between conical deflector 73 and the bottom of cylindrical wall 72 is closed. This allows feed to initially fill the chamber defined by the cylindrical conduit 72 to thereby to form a barrier which substantially prevents conveying air from directly entering the blender 11 from conduit 57. Once a sufficient inventory of material is present within cylindrical conduit 72, as determined by controller 67, shaft 71 is lowered to open the feed gap and allow material separated from the conveying air to drop into the blender 11. The material entering blender 11 is deflected by the deflecting conical surface of deflector 73 as it enters the material inventory 27 within the blender.

Controller 67 is connected to an upstream pressure sensor 63 and a downstream pressure sensor 65 of feed separator 85 and operates the driver 69 to initially maintain the gap outlet 87 closed until sufficient feed accumulates to prevent the conveying air from passing through the chamber defined by walls 72 and to thereafter control the feed gap at outlet 87 to maintain a predetermined pressure differential across the separator 85 inlet and conveying air outlet. The pressure differential is established once a certain amount of material is held in the chamber defined by conduit 72 and this desired differential pressure for operation is maintained by the controller 67. As the material in conduit 72 builds and approaches the bottom of baffle plate 77 the differential pressure rises as the conveying air has more difficulty flowing around baffle plate 77. As the material reaches and submerges the lower end of baffle plate 77, a desired differential pressure is reached. Controller 67 includes a set point which sets the desired differential pressure for operation of the feed separator 85.

The recycle air which passes through outlet 59 and enters the lower end 20 of lift pipe 19 carries with it, as it passes into the lift pipe 19, material held within the lower section 17 of the blender to cause recirculation of the material within the blender. The material which is conveyed up the lift pipe 19 passes through the outlet end 25 of the lift pipe and falls by gravity into the inventory 27. The air which passes through lift pipe 19 exits the blender vessel through outlet conduit 81.

The blender illustrated in FIG. 3 can be filled with material while material within the blender is blend at the same time using the same air flow to both convey feed to the blender and for the actual blending of the material.

After a predetermined fill level is reached in the blender 11, a rotary feed valve 503 ceases rotating so that the feed source 53 no longer supplies feed into the conduit 51 so that conveying air alone is now continually used to additionally blend any material within the inventory 27. Since at this point feed is no longer supplied to conduit 51, controller operates drive 69 to close the gap at feed outlet 87 so that all conveying air flows through conduit 59. Once blending is completed the blower 55 is shut off and bottom drain valve 31 is opened to allow the now-blended material to exit the blender 11.

As is apparent from the foregoing discussion, the blender illustrated in FIG. 3 uses a single blower 55 to provide air for conveying feed from a feed source 53 to the blender and with the feed-separated conveying air only then being used to operate the blender.

FIG. 3 also illustrates a control system for operating both the feed separator 85 and blender 11 to automatically shut down and protect the blender under upset conditions and allow for its restarting.

The control system employs a high differential pressure switch 501 which is connected to the upstream and downstream pressure sensors 63 and 65 respectively. This switch operates to detect a differential pressure which exceeds a predetermined differential pressure value representing an upset condition. When the high differential pressure switch 501 detects the predetermined value it provides an output signal to OR gate 515 which controls the rotary feed valve 503 to stop the feeding of material from feed source 53 into the conveying air stream exiting blower 55. This interrupts the feeding of material into the conveying air stream and thus interrupts the flow of material into the feed separator 85. The high differential pressure switch 501 may be of the latching type in which case the output signal remains latched once an upset condition is detected, or it may be of the type which resets itself once the upset condition, that is the high differential pressure, is no longer detected, in which case valve 503 is operated to resume the supply of feed to the conveying air flow exiting blower 55.

The control system also employs a low pressure switch 505 which detects when feed is not being applied to the conveying air stream exiting blower 55. When no feed is being conveyed to the air stream the pressure in the conveying conduit from blower 55 lowers and when this lower pressure is detected, that is, when a predetermined low pressure value is detected, the low pressure switch 505 operates to provide a timer 507 with an output signal. Timer 507 in turn provides a signal to controller 67 which causes controller 67 to open the feed gap at separator 85 feed outlet 87 wide to allow any feed material within the chamber defined by cylindrical conduit 72 to drain from the feed separator 85 into the blending vessel 11. After a predetermined period of time, timer 507 times out and no longer supplies a control signal to controller 67 which in turn allows controller 67 to return the conical deflector 73 and associated vertical shaft 71 to a closed position for the feed gap at outlet 87 whereby the feed separator 85 is conditioned to restart its operation.

The control system illustrated in FIG. 3 also employs a high pressure switch 509 which senses a high pressure in the downstream conveying air conduit 59 of the feed separator 85 via sensor 65. A high pressure indicates a blockage in lift pipe 19. When a predetermined high pressure is reached, as detected by the high pressure switch 509, the high pressure switch supplies an output signal to timer 511 which in turn provides an output signal for a predetermined period of time. The timer 511 output signal opens bypass valve 61 which causes the recycle air in conduit 59 to bypass the blender vessel 11 through bypass conduit 79 and pass directly to the outlet conduit 81. Any residual feed material which is contained in the lift pipe 19 will drain down and be carried by the conveying air in conduits 59 and 79 to the blender vessel 11 and deposited on inventory 27. This permits the lift pipe to be unclogged. After timer 511 times out, valve 61 is reset, that is, closed to ready the blender 11 for a restart condition. The output signals from the high pressure switch 509 and timer 511 are also provided to an AND gate 513 so that when both signals are present the output signal from AND gate 513 passes through an OR gate 515 and operates the control valve 503 to interrupt the supply of feed from feed source 53 to the conveying air exiting blower 55. Thus, for the time during which valve 61 is opened and lift pipe 19 is being drained, or as long as the high pressure still exists in conduit 22, the supply of feed from feed source 53 is interrupted. When timer 511 times out, and the high pressure switch 509 no longer provides an output signal, control valve 503 is controlled to allow feed from feed source 503 to enter the conveying air stream from blower 55.

The embodiment illustrated in FIG. 3 provides adequate separation of feed from conveying air and blending of the feed with the same air flow, but free of feed, which is used to convey feed to the blender. However, if there is debris such as fines, streamers, angel hair, snake skins or the like within the feed, a debris removal operation is preferably carried out either upstream or downstream of blender 11.

Figure 4:
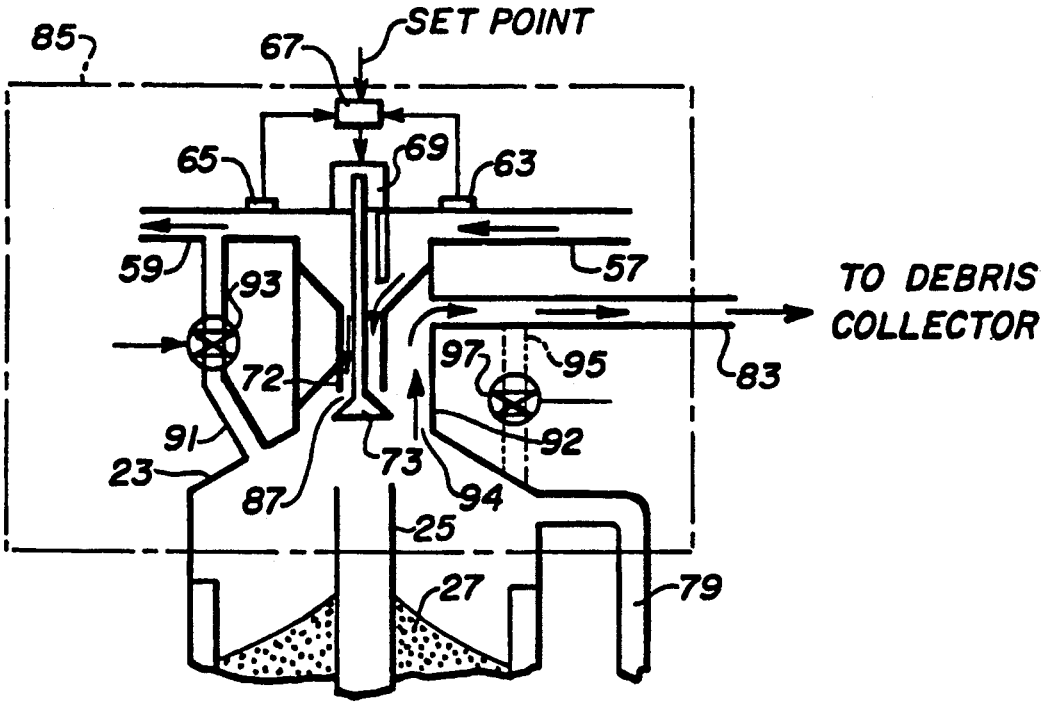
FIG. 4 illustrates a modification to the FIG. 3 blender to incorporate integral debris separation.

FIG. 4 illustrates a modification of the apparatus of FIG. 3 which allows for integral debris separation within the feed separator 85. FIG. 4 illustrates only an upper portion of blender 11, the remaining blender structures being the same as illustrated in FIG. 3. In FIG. 3 an annular wall 75 is provided at the bottom of the cylindrical conduit 72 which forces all air flow exiting the lift pipe 19 to be disbursed internally within the upper portion of the blender 11 where it then passes through outlet 81. FIG. 4 dispenses with the annular wall 75 in FIG. 3 and allows the air flow exiting the outlet 25 of lift pipe 19 to pass upwardly around the outer periphery of cylindrical conduit 72 and inside the cylindrical upper end 92 of blender 11 and into a separator outlet conduit 83. As a consequence, the air flow which exits the upward exit end 25 of the lift pipe 19 passes through the feed dropping through the gap as the air flow passes into the annulus bounded by the outside of deflector 73 and the inside of the cylindrical conduit 72. Thus, the upwardly traveling air flow is able to pass through the material feed and separate debris such as fines, streamers, angel hair, snake skins, etc. from the material feed as it drops into the blender 11. The flow pattern is such that the heavier feed materials dropping from outlet 87 fall into the inventory 27 of blender 11 whereas the lighter debris is carried away by the air flow passing through the feed dropping from outlet 87.

The operation of the feed separator 85 illustrated in FIG. 4 otherwise uses the same structures and principles of operation as the FIG. 3 separator 85.

The degree or intensity of debris separation can be controlled by controlling the air flow passing through the annulas between cylindrical conduit 72, conical defector 73 and the cylindrical upper end 92 of blender 11. This control can be accomplished by providing a bypass conduit 95 between the upper portion 23 of the blender 11 and the separator outlet 83 with a bypass control valve 97 being installed within conduit 95. By varying the amount of air flow which can pass directly from the upper portion 23 of the blender 11 to the separator outlet 83 with valve 97 a control of the rate of the air flow passing through the feed being deposited into the blender is achieved which in turn controls the amount of debris which is separated.

The FIG. 3 blender requires that the recycle air pass through the recycle air conduit 59 and up lift pipe 19. Accordingly, this recycle air flow within conduit 59 must be stopped in order to withdraw blended material from blender 11 through drain valve 31.

Figure 5:
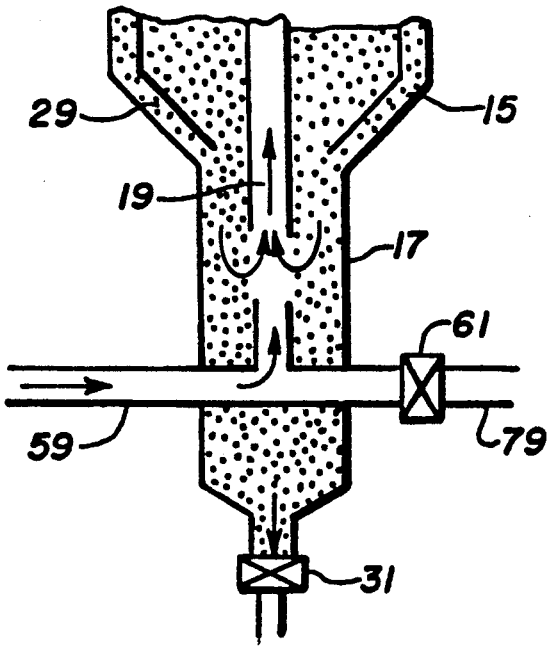
FIG. 5 illustrates a modification to the FIG. 3 blender for draining blended materials from the blender.

FIG. 5 illustrates a modification of the blender 11 in FIG. 3 at its lower portion in which blender section 17 is modified to allow for draining of the blender 11 while recirculation and blending is still being conducted. As shown in FIG. 5 drain valve 31 is directly connected to the bottom of lower section 17 of the blender, while the incoming air flow passes through conduit 59 and up through lift pipe 19. By separating the drain valve 31 and conduit 59, one can drain blender 11 while recirculation and blending is occurring.

The FIG. 4 embodiment of the invention which incorporates integral debris separation includes a control valve 97 for controlling the degree of debris separation. Although valve 97 may be manually controlled, it is preferably automatically controlled to adjust the degree or intensity of debris separation using the control apparatus illustrated in FIG. 6.

Figure 6:
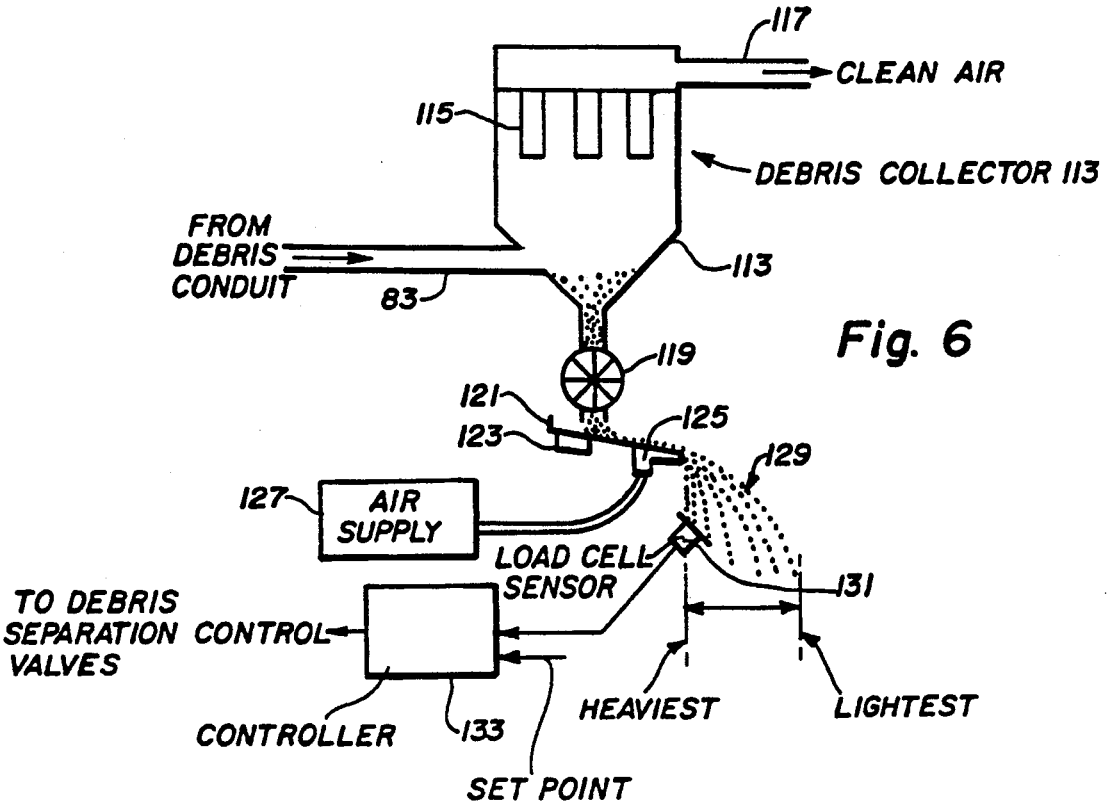
FIG. 6 illustrates an automatic control system which is preferably used with the FIG. 4 embodiment for controlling debris separation.

FIG. 6 represents an apparatus which is connected with the debris and conveying air outlet conduit 83 illustrated in FIG. 4. The debris and conveying air within conduit 83 enter a conventional debris collector 113 which includes a clean air outlet 117 and a plurality of dust bags 115 located therein. The entering debris falls to the bottom of the debris collector 113 and a rotary valve 119 is used to convey the debris at the bottom of the debris collector 113 onto an inclined pan feeder 121. The lighter dust particles are collected by the dust bags 115 as the conveying air passes therethrough to the clean air outlet 117.

The pan feeder 121 is vibrated by a piezoelectric vibrator 123 so that the debris particles which are deposited on pan feeder 121 are conveyed by vibration towards a lower end portion of the pan feeder under which is provided an air nozzle 125. The air nozzle receives air from an air supply 127 and blows the debris cascading off the end of the pan feeder 121 to separate the debris particles by weight into a range encompassing the heaviest to the lightest particles. The heaviest particles strike a load cell sensor 131 so that the rate at which the heavier particles strike sensor 131 is conveyed to a controller 133. Controller 133 includes a set point input and provides an output signal which is used to automatically control whichever one of the bypass valves 93, 97 or 61 described above is used. Thus, controller 133 operates to control, by means of the bypass valve 97, the amount of air flow passing through the feed being deposited into the blender 11 from feed separator outlet 87 to thereby vary the flow rate of the air and the degree or intensity of debris removal. If too many heavier particles strike load sensor 131 this indicates that the air flow rate through the material feed entering the blender 11 is too high and must be adjusted downwardly. Similarly, if not enough heavier particles strike load sensor 131, this indicates that the air flow needs to be increased so that a desired amount of heaviest particles are detected at load sensor 131 and the debris separating air flow through the feed is properly adjusted.

Figure 7:
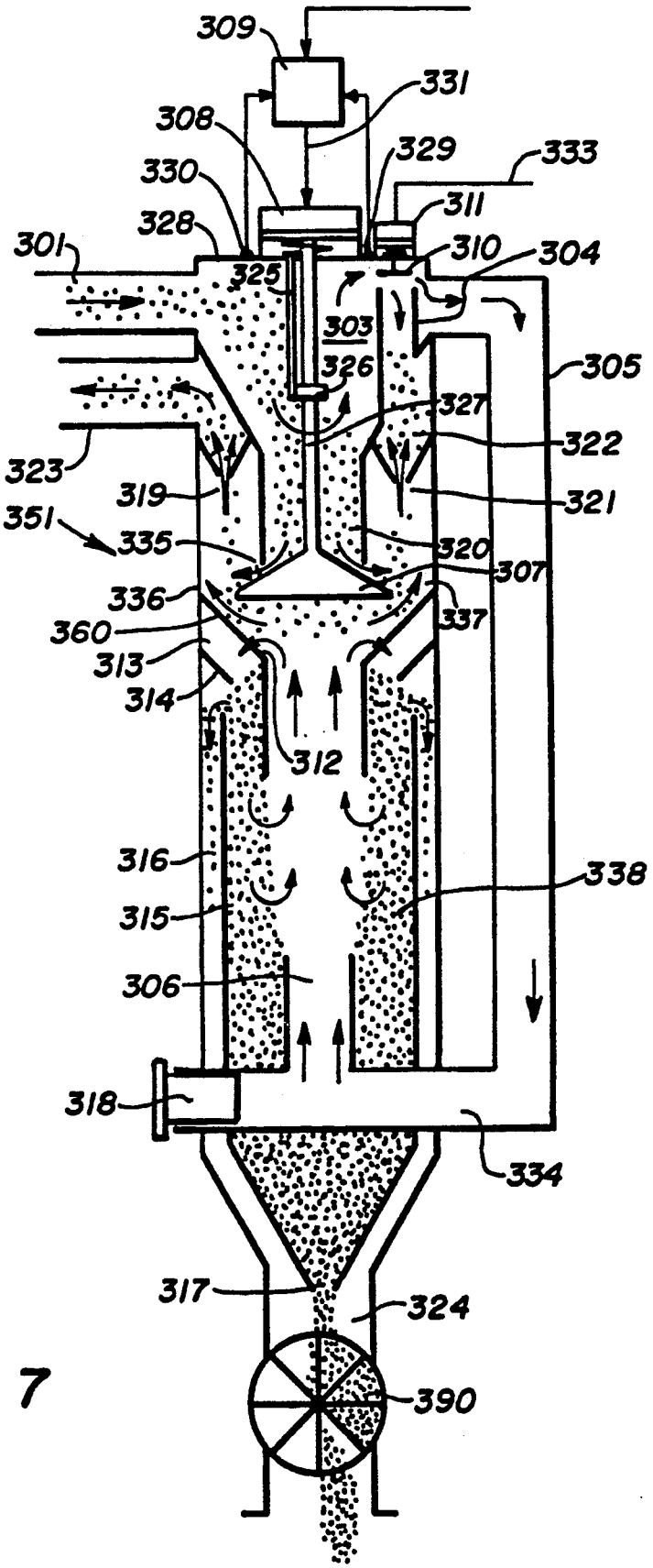
FIG. 7 illustrates a debris separator which uses a single airflow for both conveying feed material to the separator and for recycling and recirculating of feed material within the separator using feed-free air.

FIGS. 3 and 4 illustrate a technique whereby a conveying air which conveys a feed to a blender is also used as feed-free recycle air to operate the blender. The same technique can also be applied to a debris separator which separates debris from a material feed. This is illustrated in FIG. 7 which discloses a recycling feed separator 351 which uses conveying air to both convey a feed to the separator and to operate the recycle cleaning within the separator.

The separator operates to separate debris from a conveyed feed material, such as plastic pellets which have been discussed throughout this application. The removed debris includes fines, streamers, "snake skins", and "angel hair", etc. The conveyed feed enters the separator 351 through an inlet conduit 301. A feed source and associated blower are not illustrated in FIG. 7, although these elements are in a manner similar to that illustrated in FIG. 3. The entering feed strikes a baffle plate 325 located in an inlet chamber 328. The feed falls from the baffle late 325 and accumulates in an annular flow conduit 320 which has a controlled feed gap at outlet 335 provided at its lower end. This feed gap is opened and closed by means of a conical deflector 307 which is connected to a vertically adjustable shaft 327 and controlled by a shaft driver 308. The conveying air moves around baffle 325 and enters a conveying air flow conduit 303 and then a conveying air conduit 305. At this point the feed has been removed from the conveying air so that conveying air only flows through the conveying air conduit 305.

The conical deflector 307 is operated by control shaft 327 so that the gap at outlet 335 is closed during start up of separator 351. Once a feed inventory has built up in the cylindrical conduit 320 sufficient so that conveying air entering inlet chamber 328 cannot go directly downwardly through cylindrical conduit 320, the controller 309 operates the shaft driver 308 to open a gap at outlet 335 and meter a feed within the cylindrical flow conduit 320 onto the upper surfaces of the conical deflector 307 where it is disbursed by gravity and falls through support gussets 360 for a lift pipe 312 and is guided by a funnel-like guide 314 into the product inventory chamber 315. The funnel-like guide 314 is attached to support gussets 362 and the separator shell 336. The inventory chamber 315 contains a product inventory 338 which, when sufficient to overflow the top of chamber 315, overflows into an annular cleaned product conduit 316 from which it passes to a cleaned product outlet 324. The product inventory chamber 315 also has a lower bottom outlet 317 which permits draining of the product inventory chamber 315 at shutdown. A rotary valve 390, which rotates at a desired rate, meters the flow of cleaned product from cleaned product outlet 324 and prevents air from exiting with the cleaned product.

Recycle air which passes through conduit 305 is directed upwardly through a recycle air inlet 306 into the product inventory chamber 315. The upwardly directed air then passes into the lift pipe 312 which is concentric with and has a larger diameter than the recycle air inlet 306. Since the recycle air inlet 306 is spaced from the lift pipe 312, product residing within the product inventory chamber 315 is pulled upwardly with the upwardly rushing air flow through the lift pipe 312 whereupon gravity causes the feed to drop downwardly through a clean product section 313 and onto funnel-like product guide 314 whereby it is returned to the product inventory chamber 315 for recirculation. The upwardly flowing conveying air also passes through newly entering feed which is cascading off conical deflector 307 and carries debris both from the product flowing up through lift pipe 312 and product flowing off of deflector 307. The debris and conveying air then pass through an annular flow conduit 321 and into a debris and conveying air outlet conduit 323.

The controller 309, functions like controller 67 in FIGS. 3 and 4 and operates driver 308 to move shaft 327. It receives signals from upstream and downstream pressure sensors 329 and 330 respectively and a set point and operates driver 308 to adjust the conical deflector 307 and the feed gap at outlet 335 to maintain a desired product level within the cylindrical feed conduit 320.

In order to control the intensity or degree of debris separation a bypass conduit 304 is also provided together with a control valve 310 therefore. The bypass conduit 304 allows air within conveying air flow conduit 303 to pass directly into the debris and conveying air conduit 322 and into outlet 323 without passing through the conveying air conduit 305. Thus, by controlling the operation of valve driver 311, which controls the opening conditions of valve 310, one can control the intensity or degree of debris separation. The control signal for driver 311 is produced by the control system illustrated in FIG. 6 in which case the outlet conduit 323 of FIG. 7 is connected to inlet conduit 83 of FIG. 6.

The debris separator 351 of FIG. 7 includes a plug 318 at the end of the recycle air conduit 305 which can be removed for providing, for example, a direct bypass of conveying air to the outlet conduit 323, if desired and in lieu of the bypass conduit 304. Of course, a valve would be provided in this bypass (not illustrated) similar to valve 310.

The debris separator 351 provides a continuous recirculation of product from the product inventory chamber 315 through the lift pipe 312 by means of the conveying air passing through the recycle air inlet 306. The debris separation which occurs is two fold, one by the recirculation of the product within the product inventory chamber 315 and the second by the upflowing air which passes through product entering the separator through the gap at outlet 335 and flowing downwardly over the conical surface 307 toward the product inventory chamber 315.

Figure 8:
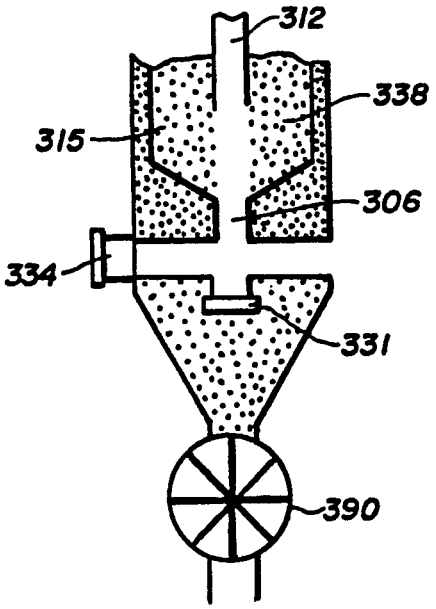
FIG. 8 illustrates a modification to the separator illustrated in FIG. 7.

FIG. 7 illustrates a separator 351 which allows for continuous withdrawal of clean product through the product inventory bottom outlet 317 as well as through the annular clean product conduit 316 by rotary valve 390. FIG. 8 illustrates a modification wherein the bottom of the product inventory chamber terminates at the recycle air inlet 306. Cleaned product is thus continuously removed by a feed overflow of the product inventory chamber 315, the overflowing feed passing through annular conduit 316 and rotary valve 390. To remove cleaned feed from a product inventory 338 with this arrangement, a drain valve 331 is provided below the recycle air inlet 306.

The separators illustrated in FIGS. 7 and 8 are designed for continuously withdrawing cleaned feed during a separation operation.

Another advantageous by-product of the use of a single conveying air source for both conveying product and blending product as disclosed in connection with the FIG. 3 embodiment above, is that a plurality of blenders can be operated simultaneously with one blender being filled with feed while blending occurs in another blender. By cycling back and forth between the two blenders, a continuous blending operation is achieved using a single feed-conveying air flow, with consequence savings in cost and system complexity.

Figure 9:
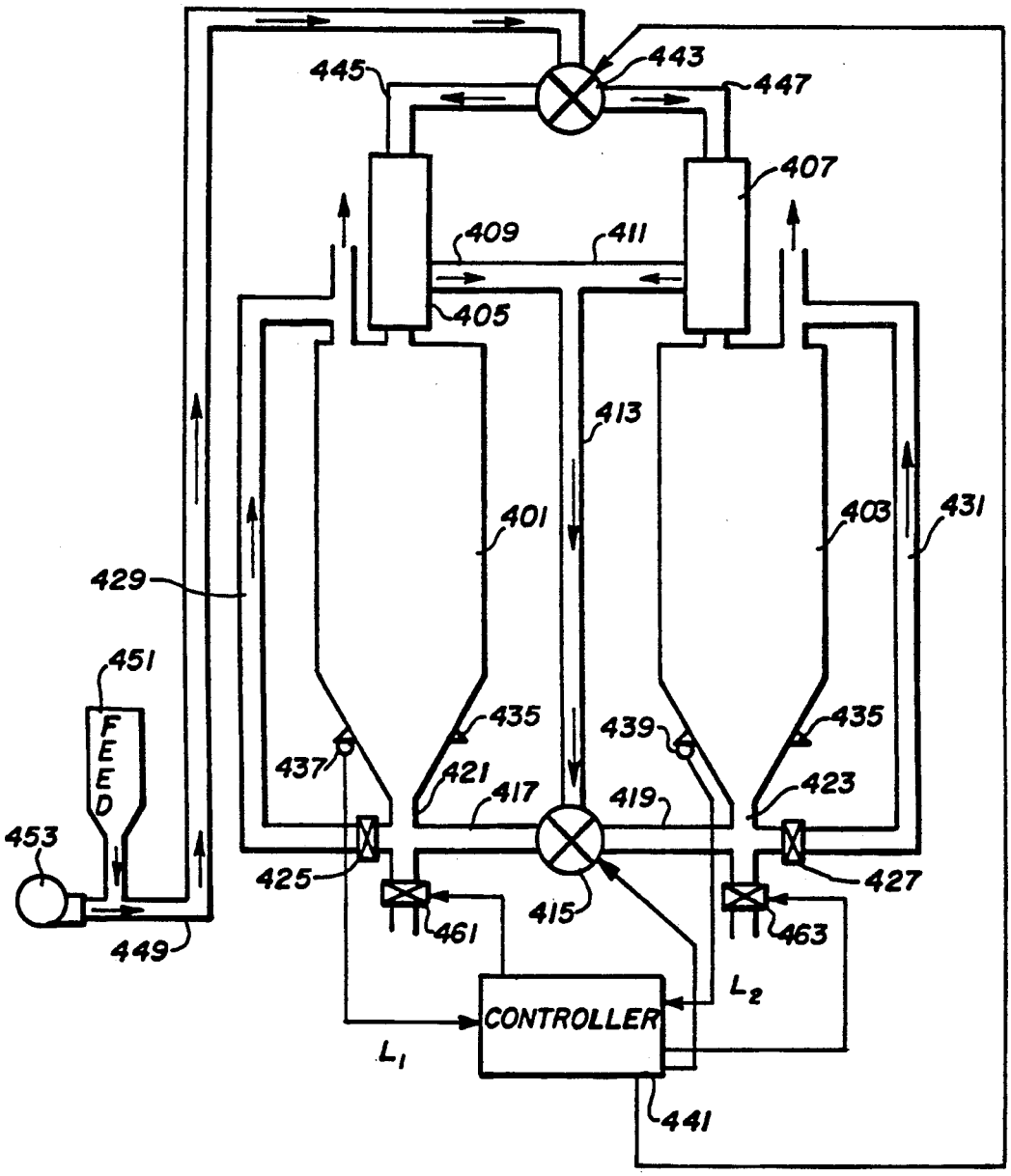
FIG. 9 illustrates a blending system employing two of the blenders of FIG. 3 which are alternately fed and blended using a single air source for conveying feed to the blenders and to subsequently recycle and recirculate material within a blender using feed-free air.

This arrangement is illustrated in greater detail in FIG. 9.

FIG. 9 shows two separate blenders 401 and 403 each having the structural configuration illustrated in FIG. 3 of the application. Each blender 401 includes an integral feed separator as illustrated at 85 in FIG. 3, and respectively illustrated in FIG. 9 as separators 405 and 407. The construction and operation of each of respective blenders 401 and 403 and feed separators 405 and 407 are as described above with respect to FIG. 3, and FIG. 3 is referred to for the detailed description of the internal structures and mode of operation of each of these blenders.

The blenders 401 and 403 are connected in common to a single blower 453 and associated feed source 451 which together provide a conveyed feed through conduit 449 to a switching type control valve 443. Control valve 443 operates to pass conveyed feed and air flow through either conduit 445 to feed separator 405 or through conduit 447 to feed separator 407. The conveyed air which has the feed separated therefrom in either separator 405 or 407 then passes through either of outlet conduits 409 or 411 into a common conduit 413 and then to another switching type control valve 415 which controls the flow of air through either conduit 417 or 419. If the conveying air passes through the conduit 417 it enters as recycled air to recycle air input 421 of blender 401. On the other hand, if the conveying air passes through recycle air conduit 419 it then enters recycle air input 423 of blender 403. The switching control valves 443 and 415 are controlled by a controller 441.

Controller 441 also controls the opening and closing of drain valves 461 and 463 which are respectively provided for blenders 401 and 403. Bypass control valves 425 and 427 are also respectively provided for blenders 401 and 403 and operate to bypass all or a portion of the recycle air passing through respective conduits 417 and 419 to outlet conduits 429 and 431 respectively for blenders 401 and 403. Controller 441 also receives as input signals outputs from respective load sensors 437 and 439 which respectively sense the fill level in blenders 401 and 403.

The manner in which controller 441 operates the blenders 401 and 403 simultaneously will now be explained with reference to the following table illustrating an operating cycle.

TABLE OF OPERATING CYCLE

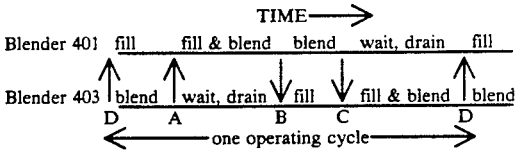

A valve 415 changes from blender 403 to blender 401
B valve 443 changes from blender 401 to blender 403
C valve 415 changes from blender 401 to blender 403
D valve 443 changes from blender 403 to blender 401

The above table illustrates the beginning of a feed fill cycle for blender 401 at which time valve 443 is operated by controller 441 to divert an incoming feed and conveying air from conduit 449 to inlet conduit 445 and thus separator 405 associated with blender 401. As incoming feed and conveying air enter separator 405 the conveying air from separator 405 devoid of feed passes through conduits 409 and 413 and through valve 415 into conduit 419 and recycle input 423 whereby it is used to blend the feed then contained in blender 403. This state continues until a predetermined fill level e.g. ⅓ to ½ of maximum fill capacity, is detected in blender 401 by load sensor 437. The controller 441 recognizes when the predetermined fill level has been achieved and then operates valve 415 to divert conveying air exiting separator 405 from conduit 413 into conduit 417 whereby a filling and blending stage is entered for blender 401 where filling continues, while at the same the time, the contents thereof are being blended by recycle air entering at inlet 421. At this time, blender 403 is in wait state as no recycle air enters inlet 423, and after a predetermined period of time controller 441 then operates drain valve 463 to drain the blended contents from blender 403. When the contents of blender 403 are drained, by controller 441 keeping track of a period of time during which draining is conducted, controller 441 then operates valve 443 to divert incoming feed and conveying air from conduit 449 into conduit 447 and separator 407. Now the incoming feed starts to be loaded into blender 403 while the separated conveying air passing through conduit 411 still passes through valve 415, and through conduit 417, to continue the blending operation in blender 401. This operation continues until controller 441 detects a predetermined load level at load sensor 439 indicating that blender 403 is approaching a predetermined fill level, e.g. ⅓ to ½ of maximum fill, at which time controller 441 operates control valve 415 to divert the air flow in conduit 413 into conduit 419 and recycle air input 423 whereupon a filling and blending operation in blender 403 occurs. At the same time, since the air flow is no longer flowing through conduit 417, blender 401 is placed in a wait state for a predetermined period of time following which controller 441 operates the drain valve 461 to drain the blended material from blender 401. At the completion of the draining of blender 401, that is, after a predetermined time period, controller 441 operates control valve 443 to divert the feed and conveying air into conduit 445 and the operation cycle described above repeats itself. In addition, the feed separators 405, 407 may have the construction shown in FIG. 4 which would also provide for debris separation as part of the feed separation operation.

As a modification of the operating sequence illustrated in the table above, a blender which is in a blending stage, following a filling and blending stage, can also be operated by controller 441 to begin draining while blending is continuing.

In this manner, at least two blenders 401 and 403 are operated simultaneously and in sequence with a single air flow from blower 453 to both convey feed and to efficiently conduct blending in both blenders. The system permits blending in one filled blender for a period of time after it is filled while another blender is simultaneously being filled and reduces the need for additional blowers and conveying conduits and provides for an efficient continuous blending and filling of the two blenders and a more efficient overall operation of each.

While various embodiments of the invention have been described and illustrated above in connection with FIGS. 3–9, it should be apparent that many modifications can be made to the invention without departing from its spirit and scope. Accordingly, the invention is not limited by the foregoing description, but is only limited by the scope of the appended claims.

I claim:

1. A method for separating debris from a conveyed material which is transported by a fluid flow, said method comprising the steps of:

receiving said fluid flow including said conveyed material;

separating said conveyed material from said fluid flow to produce a separated material and a separated fluid flow;

passing said separated material into an upper open end of a first chamber for containing an inventory of separated material;

passing said separated fluid flow into a lower portion and through said first chamber to convey a portion of the separated material within said first chamber upwardly and out of said first chamber; and, defining a flow path for said separated fluid flow after it exits said first chamber which allows said portion of material conveyed from said first chamber to be redeposited by gravity back into said first chamber through said open end thereof and which causes said fluid flow passing through said first chamber to also pass through separated material which passes to said open end of said first chamber, whereby said fluid flow passing through said first chamber removes and carries debris from said conveyed portion of material and from said material passing into said chamber.

2. An apparatus for separating a conveyed material from a conveying fluid flow which transports said material, said apparatus comprising:

an inlet for receiving said conveying fluid flow including said conveyed material;

a deflector positioned to be stricken by conveyed material passing through said inlet, said deflector causing said conveyed material to follow one path from said deflector and separated conveying fluid to follow another path from said deflector such that said conveyed material is separated from said conveying fluid flow;

a material conduit receiving material deflected from said deflector, said material conduit including a controllable gap material outlet; said gap being defined by said material conduit and a conical deflector positioned to close or open said material conduit to define said controllable gap; and a fluid outlet for receiving said separated conveying fluid substantially devoid of said conveyed material;

a movable control shaft connected to said conical deflector to move said deflector, and a driver for controlling movement of said control shaft; and means for controlling said driver to thereby control the position of said conical deflector, a first pressure sensor positioned to detect the pressure at said inlet, a second pressure sensor positioned to detect the pressure at said separated conveying fluid outlet, the outputs of said first and second pressure sensors being applied, together with a set point, to said controlling means.

3. A separating apparatus as in claim 2 wherein said material conduit is vertically disposed and wherein said controlling means operates said driver to cause said conical deflector to close said gap until a predetermined amount of material has collected in said material conduit, after which said controller causes said gap to open.

4. An apparatus for separating debris from a conveyed material which is transported by a fluid flow, said apparatus comprising:

an inlet for receiving said fluid flow including said conveyed material;

means for separating conveyed material from a fluid flow passing through said inlet to produce a separated material and a separated fluid flow;

means for passing said separated material into an upper open end of a first chamber for containing an inventory of separated material;

means for passing said separated fluid flow into a lower portion of and through said first chamber to convey a portion of the separated material within said first chamber upwardly and out of said first chamber; and, means defining a flow path for said separated fluid flow after it exits said first chamber which allows said portion of material conveyed from said first chamber to be redeposited by gravity back into said first chamber through said upper open end thereof and which causes said fluid flow passing through said first chamber to also pass through separated material which passes from said separating means to said upper open end of said first chamber, whereby said fluid flow passing through said first chamber removes and carries debris from said conveyed portion of material from said first chamber and from said material passing from said separating means into said chamber; and an outlet for passing said separated fluid flow carrying debris.

5. An apparatus as in claim 4 wherein said means for separating conveyed material comprises a second chamber connected to said inlet, and a first deflector within said second chamber which is struck by conveyed material, to separate conveyed material from a fluid flow which passes through said second chamber as said separated fluid flow.

6. An apparatus as in claim 5 wherein said first deflector is positioned substantially normal to a direction of fluid flow passing through said inlet.

7. An apparatus as in claim 5 wherein said means for passing separated material into an open end of said first chamber comprises a material conduit having an open upper end positioned to receive material deflected from said first deflector and a closable lower end which can be opened to permit material from said material conduit to pass by gravity into said open upper end of said first chamber.

8. An apparatus as in claim 7 wherein said closeable lower end of said material conduit includes a controllable gap material outlet.

9. An apparatus as in claim 8 further comprising means for controlling said driver to thereby control the position of said conical deflector, a first pressure sensor positioned to detect fluid pressure at said inlet, a second pressure sensor positioned to detect the pressure at a separated fluid outlet of said fluid separating apparatus, outputs of said first and second pressure sensors being applied, together with a set point, to said controlling means, said controlling means operating on a differential pressure existing between said fluid inlet and fluid outlet caused by a build-up of material within said material conduit toward a lower end of said first deflector.

10. An apparatus as in claim 8 wherein said gap is defined by said material conduit and a second deflector, said second deflector being conical and positioned to close and open said material conduit to define said controllable gap, said conical deflector, when said gap is open, guiding material from said material conduit into the upper open end of said first chamber.

11. An apparatus as in claim 10 further comprising an inclined funnel-like deflector for deflecting material from said conical deflector to said upper open end of said first chamber.

12. An apparatus as in claim 4 wherein said means for passing said separated fluid flow into a bottom of and through said first chamber comprises a first upwardly directed conduit positioned concentrically with a lower portion of said first chamber, an upwardly directed lift pipe positioned concentrically within an upper portion of said first chamber, the diameter of said lift pipe being larger than that of said first conduit and said first conduit and lift pipe being spaced apart in an axial direction of both, whereby a fluid flow directed upwardly through said first conduit and lift pipe conveys said portion of material held within said first chamber upwardly.

13. An apparatus as in claim 4 further comprising an overflow passage for receiving material which overflows the upper open end of said first chamber and for passing said over flow material to a cleaned material outlet.

14. An apparatus as in claim 13 wherein said over flow passage is concentric with and surrounds said first chamber and extends along a vertical extent of said first chamber.

15. An apparatus as in claim 13 further comprising an exit passage at the bottom of said first chamber for passing material within said first chamber to said cleaned material outlet.

16. An apparatus as in claim 4 further comprising means for diverting a portion of said separated fluid flow from entering said first chamber.

17. An apparatus as in claim 16 wherein said diverting means comprises a passage for diverting separated fluid flow from said means for separating so that it passes to said outlet without passing through said first chamber.

18. An apparatus as in claim 16 further comprising a control valve for controlling the amount of separated fluid flow entering said diverting passage, and a control system for controlling said control valve with a control signal.

19. An apparatus as in claim 18 wherein said control system comprises:

means for removing collected debris from the fluid flow passing through said outlet, means for segregating removed debris in accordance with a predetermined characteristic, and means for determining the flow rate of debris having said predetermined characteristic and providing said control signal which is representative thereof.

* * * * *